US007448305B2

(12) United States Patent
Kurtz

(10) Patent No.: US 7,448,305 B2
(45) Date of Patent: Nov. 11, 2008

(54) APPARATUS FOR TRIMMING BROCHURES

(75) Inventor: Jürgen Kurtz, Leipzig (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 102 days.

(21) Appl. No.: 11/097,078

(22) Filed: Apr. 1, 2005

(65) Prior Publication Data

US 2005/0247176 A1 Nov. 10, 2005

(30) Foreign Application Priority Data

May 4, 2004 (DE) ..... 10 2004 021 959

(51) Int. Cl.
*B26D 1/08* (2006.01)

(52) U.S. Cl. ..... 83/155; 83/694; 83/934

(58) Field of Classification Search . 83/435.11–435.25, 83/934, 904, 155, 282, 262, 697, 613, 679, 83/694, 92, 92.1, 77, 155.1
See application file for complete search history.

(56) References Cited

U.S. PATENT DOCUMENTS

| | | | | |
|---|---|---|---|---|
| 2,076,969 | A * | 4/1937 | Sieger | 83/20 |
| 2,347,818 | A * | 5/1944 | Folk | 83/268 |
| 3,250,162 | A * | 5/1966 | Bunting | 83/23 |
| 3,552,246 | A | 1/1971 | Bryson et al. | |
| 4,436,469 | A | 3/1984 | Kelly | |
| 4,662,255 | A | 5/1987 | Toon | |
| 5,121,538 | A * | 6/1992 | Kerr | 483/7 |
| 5,724,874 | A * | 3/1998 | Lindee et al. | 83/27 |
| 6,006,638 | A * | 12/1999 | Eltringham | 83/86 |
| 6,796,209 | B2 | 9/2004 | Boss | |
| 2004/0040997 | A1 * | 3/2004 | Ueyama et al. | 225/96.5 |
| 2004/0112195 | A1 | 6/2004 | Lorenzi | |
| 2005/0247176 | A1 | 11/2005 | Kurtz | |

FOREIGN PATENT DOCUMENTS

| | | | |
|---|---|---|---|
| DE | 10 2004 021 959 | A1 | 12/2005 |
| EP | 1 166 977 | A1 | 1/2002 |
| WO | 02/078916 | A2 | 10/2002 |

* cited by examiner

*Primary Examiner*—Kenneth E. Peterson
(74) *Attorney, Agent, or Firm*—Laurence A. Greenberg; Werner H. Stemer; Ralph E. Locher

(57) ABSTRACT

An apparatus for trimming brochures has a pair of front cutting blades and a transport apparatus for guiding the brochures to the pair of front cutting blades. For an operator-friendly changeover of the apparatus which is associated with little expenditure, in the event of a change of the distance between the front edges of the brochures and their respective setpoint cutting line, the transport apparatus can be locked at adjustable distances from the pair of front cutting blades.

2 Claims, 3 Drawing Sheets

APPARATUS FOR TRIMMING BROCHURES

BACKGROUND OF THE INVENTION

Field of the Invention

The invention relates to an apparatus for trimming brochures. The apparatus has a pair of front cutting blades and a transport apparatus for guiding the brochures to the pair of front cutting blades.

An apparatus of this type forms a constituent part of an assembly marketed by Brehmer Buchbindereimaschinen AG of Germany under the name Rückstich-Broschurenstrecke 750. There the apparatus has a transport system in a trimming station which comprises the pair of front cutting blades, which transport system aligns the spines of the brochures transferred to it against a stop which is positioned in such a way that the pair of front cutting blades trims the brochures along a respective setpoint cutting line. The transport system is preceded by a trimmer feed means. In order to ensure the reliable transfer of the brochures by means of the trimmer feed means to the above-mentioned transport system, in particular in the case of small formats of the brochures, it is necessary to guide the brochures as near as possible to the pair of front cutting blades by way of the trimmer feed means. The distance between the pair of front cutting blades and the trimmer feed means should be set as a function of the width of the respective strip to be cut from the brochures, what is known as the cutoff width in front trimming, in order to achieve reliable falling of cutting waste when separating a strip having a defined cutoff width from the respective brochure. The setting of the respectively required distance between the pair of front cutting blades and the trimmer feed means requires a certain amount of fitting time. For that purpose, components have to be released, displaced and fixed once more by means of tools in the above-mentioned prior art apparatus.

SUMMARY OF THE INVENTION

It is accordingly an object of the invention to provide an apparatus for trimming brochures which overcomes the above-mentioned disadvantages of the heretofore-known devices and methods of this general type and wherein the apparatus is configured such that it requires as short a fitting time as possible for the changeover to a job for which the above-mentioned cutoff width is changed.

With the foregoing and other objects in view there is provided, in accordance with the invention, an apparatus for trimming brochures, comprising:

a pair of front cutting blades;

a transport apparatus for guiding the brochures to the pair of front cutting blades; and a locking device for locking the transport apparatus at adjustable distances from the pair of front cutting blades.

In other words, the objects of the invention are satisfied by rendering it possible to lock the transport apparatus at adjustable distances from the pair of front cutting blades.

If a relatively wide gap is to be set between the pair of front cutting blades and the transport apparatus in the case of a relatively large cutoff width, that is to say a relatively large width for the strips to be separated from the brochures, a development in this respect proves to be advantageous in that the transport apparatus has a ramp which raises that end of the transport apparatus which faces the pair of front cutting blades when the transport apparatus is moved away from the pair of front cutting blades.

Other features which are considered as characteristic for the invention are set forth in the appended claims.

Although the invention is illustrated and described herein as embodied in an apparatus for trimming brochures, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
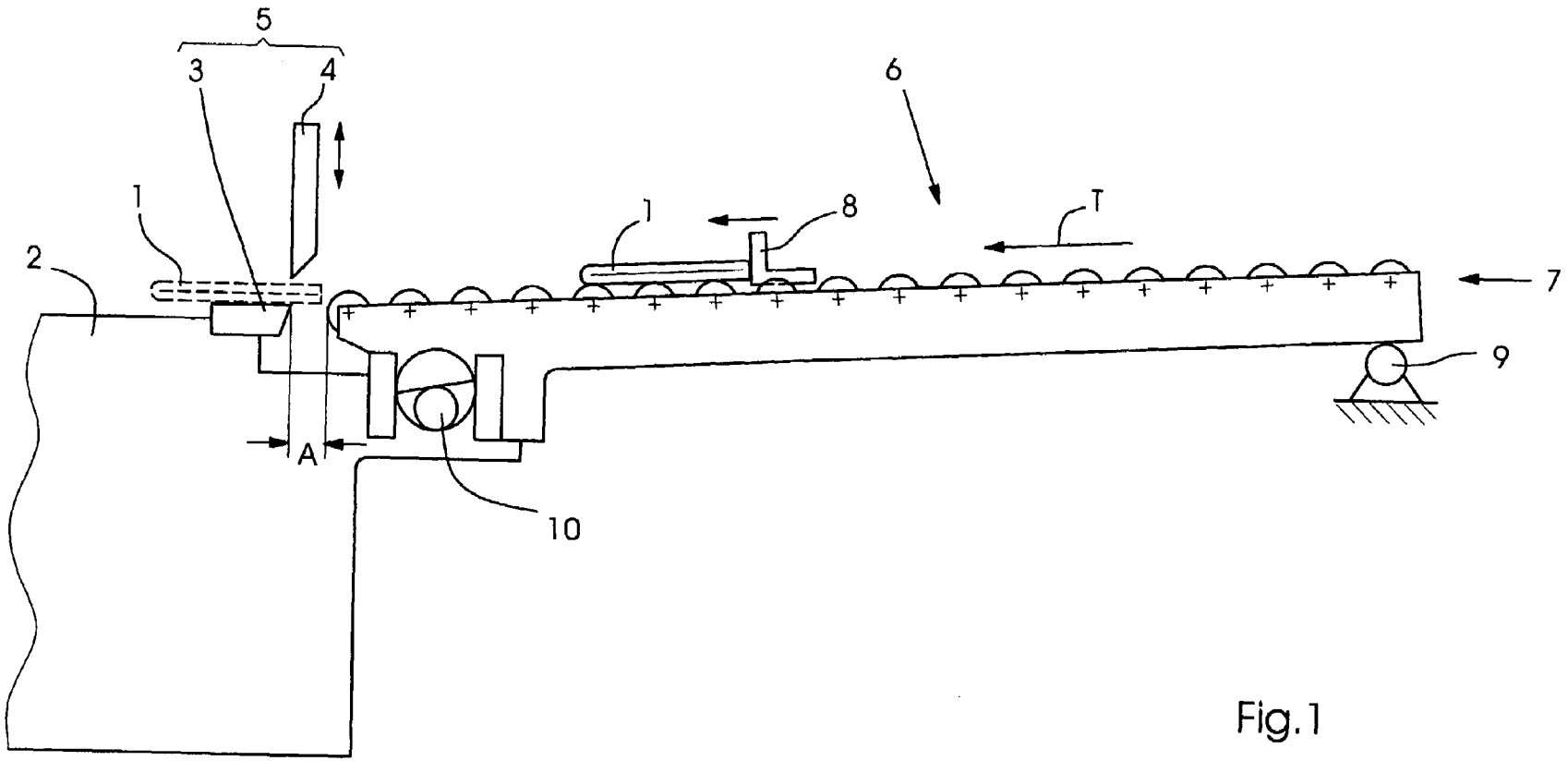
FIG. 1 is a diagrammatic side view of a section of a trimmer for trimming brochures and a transport apparatus for guiding the brochures to a pair of front cutting blades of the trimmer.

Referring now to the figures of the drawing in detail and first, particularly, to FIG. 1 thereof, there is shown an apparatus for trimming brochures 1 according to the invention. The apparatus comprises a pair of front cutting blades 5 formed from a lower blade 3 which is arranged fixedly in terms of position on a trimmer frame 2 and an upper blade 4 which interacts with the latter, and a transport apparatus 6 for guiding the brochures 1 to the pair of front cutting blades 5.

In the present exemplary embodiment, the transport apparatus 6 carries the brochures 1 by way of a roller track 7 and the transport is carried out by way of drivers 8 which are disposed on non-illustrated endless chains that circulate during operation.

An end of the transport apparatus 6 which faces away from the trimmer frame 2 rests on a stationary support 9, for example in the form of a freely rotatable roller, on which the transport apparatus 6 can roll when it is being set to different distances A from the pair of front cutting blades 5.

Figure 2:
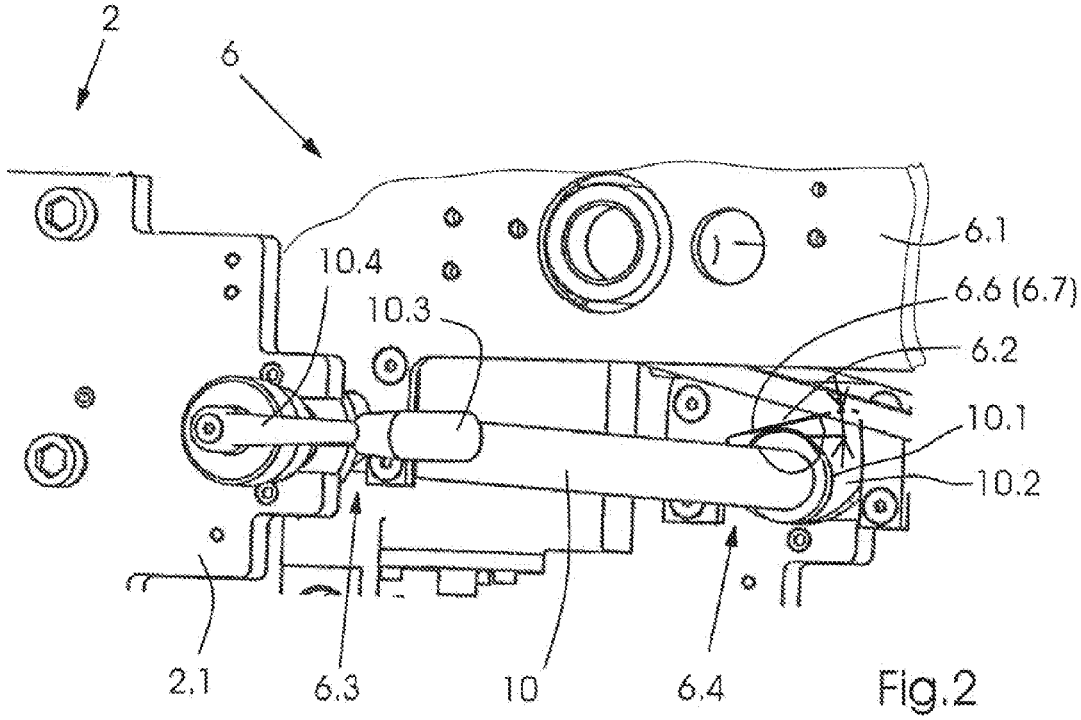
FIG. 2 is a perspective detail illustrating a first embodiment of the connection of the transport apparatus to the trimmer.
Figure 3:
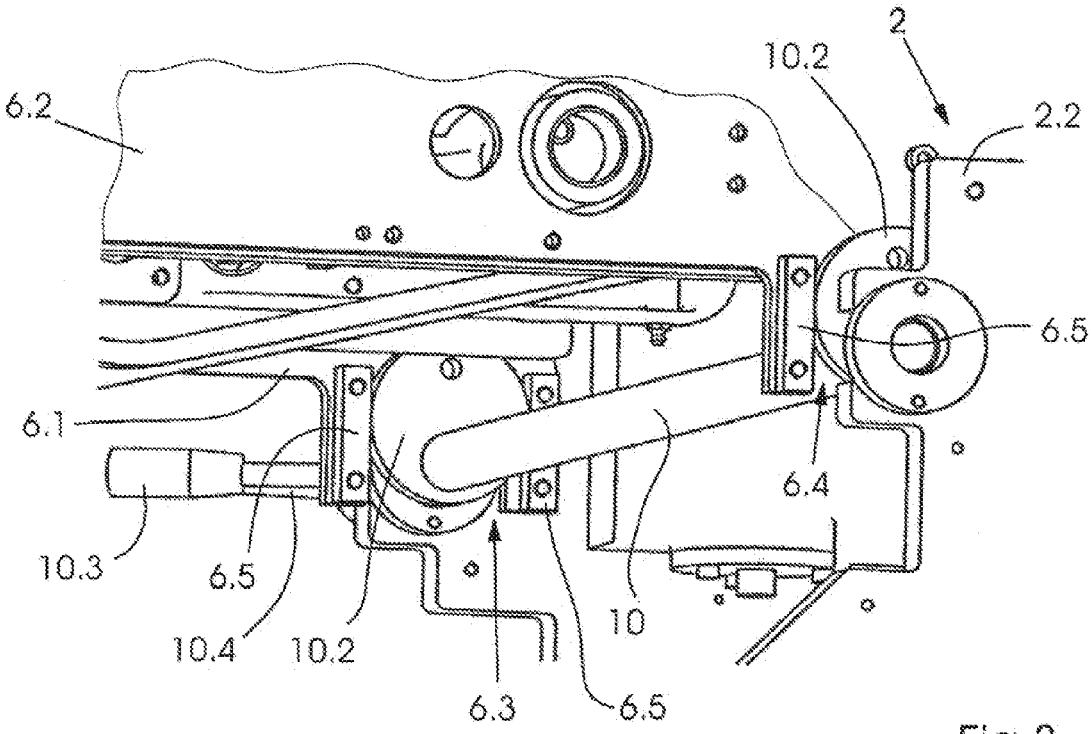
FIG. 3 is a perspective view showing the embodiment of FIG. 2 from a different viewing angle.

Referring now to FIGS. 2 and 3, an adjusting shaft 10 which is supported by side parts 2.1 and 2.2 of the trimmer frame 2 is provided to support that end of the transport apparatus 6 which faces the trimmer frame 2. A respective side cheek 6.1 and 6.2 of the transport apparatus 6 is positioned on this adjusting shaft 10, or more accurately on a respective end-side collar 10.1 of the latter, to be precise with a supporting face 6.6 formed on a respective side cheek 6.1 and 6.2.

In order to set various distances A between the transport apparatus 6 and the pair of front cutting blades 5, an eccentric disk 10.2 which is fixed in terms of rotation with respect to the adjusting shaft 10 is provided on a respective end of the adjusting shaft 10. Each respective eccentric disk 10.2 engages in a slotted guide 6.3 and 6.4 provided on a respective side cheek 6.1 and 6.2. Each of the slotted guides 6.3 and 6.4 has an extent in the longitudinal direction of the transport apparatus 6 which corresponds to the diameter of the eccentric disks 10.2.

A front and rear limit (with regard to the transport direction according to arrow T in FIG. 1) for each of the slotted guides 6.3 and 6.4 is formed in each case by a sliding rail 6.5 which is in contact with the corresponding eccentric disk 10.2 and is fastened to the respective side cheek 6.1 and 6.2 of the transport apparatus 6.

An adjusting lever 10.3 is connected fixedly in terms of rotation to the adjusting shaft 10 at one end of the latter. When the adjusting shaft 10 is rotated by means of said adjusting lever 10.3, the eccentric disks 10.2, being in contact with the sliding rails 6.5, displace the transport apparatus 6 in one or the opposite displacement direction, depending on the rotational direction.

The supporting face 6.6 which represents a respective upper limit of the respective slotted guide 6.3 and 6.4 is preferably configured in the form of a ramp 6.7 which falls away in the direction toward the trimmer frame 2 and to this extent raises that end of the transport apparatus 6 which faces the pair of front cutting blades 5 when the transport apparatus 6 is moved away from the pair of front cutting blades 5.

In this way, sagging of the leading edges of the brochures is taken into consideration in an advantageous way in the case of a large cutoff width.

Figure 4:
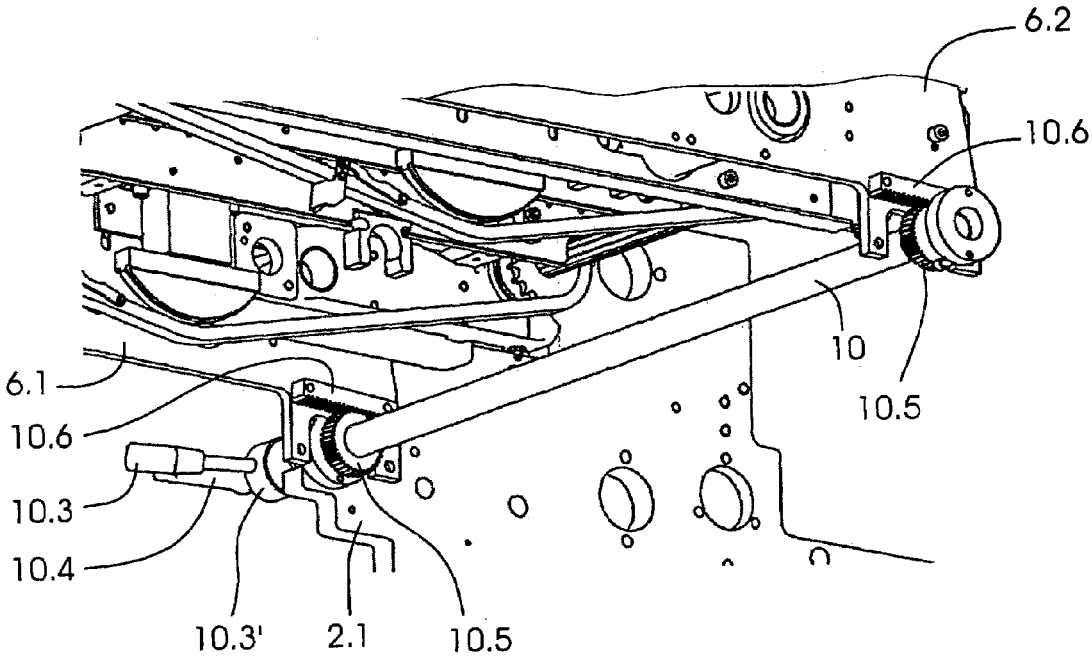
FIG. 4 is a perspective view of a second embodiment of the connection between the transport apparatus and the trimmer.

FIG. 4 illustrates an alternative to the displacement mechanism illustrated in FIGS. 2 and 3. Here, given an otherwise identical configuration of the trimmer frame 2 and the transport apparatus 6, the eccentric disks 10.2 are replaced, in functional terms, by crown gears 10.5 and the sliding rails 6.5 of a respective slotted guide 6.3 and 6.4 are each replaced by a rack 10.6 which is oriented in the displacement direction and meshes with a respectively assigned crown gear 10.5.

The transport apparatus 6 is displaced in order to set its distance A from the pair of front cutting blades 5 in the same way as in the mechanism which operates with the eccentric disks 10.2, by rotating the adjusting shaft 10 by means of the adjusting lever 10.3 which is arranged on it fixedly in terms of rotation.

In both alternatives, the same locking means are provided, by means of which the transport apparatus 6 can be locked at adjustable distances A from the pair of front cutting blades 5. These locking means comprise a thread cut onto an end section and a clamping lever 10.4 provided with a nut thread which interacts with the other thread, at the same end of the adjusting shaft 10 at which the adjusting lever 10.3 is arranged. The rotationally fixed connection of the adjusting lever 10.3 to the adjusting shaft 10 is configured in such a way that the adjusting lever 10.3 is merely pushed onto the adjusting shaft, that is to say is not fixed on the adjusting shaft 10 in the axial direction. For example, the adjusting lever 10.3 has a hub 10.3' which is connected to the adjusting shaft 10 via a key and can be pressed against the directly adjacent side cheek 6.1 or 6.2 (cf. FIG. 4), with the result that the hub 10.3' is pressed against the abovementioned directly adjacent side cheek 6.1 or 6.2 (here, against the side cheek 6.1) by screwing the clamping lever 10.4 onto the thread of the adjusting shaft 10, and therefore the rotational position of the adjusting shaft 10 and thus the position of the transport apparatus 6 assumed in the process are fixed.

Both the displacement mechanism which operates with the eccentric disks 10.2 and the sliding rails 6.5 and the displacement mechanism with operates with the crown gears 10.5 and the racks 10.6 obviously permit the infinitely variable adjustment of the distance A between the transport apparatus 6 and the pair of front cutting blades 5.

This application claims the priority, under 35 U.S.C. § 119, of German patent application No. 10 2004 021 959.1, filed May 4, 2004; the disclosure of the prior application is herewith incorporated by reference in its entirety.

I claim:

1. An apparatus for trimming brochures, comprising:

a pair of front cutting blades configured for trimming the brochures;

a substantially horizontally oriented transport apparatus configured for guiding the brochures to said pair of front cutting blades in a horizontal direction, said transport apparatus and said cutting blades defining a gap therebetween, said gap having a horizontal extent, said transport apparatus having a first end facing said pair of front cutting blades; and a mechanism for horizontally moving said transport apparatus thereby varying said gap, said transport apparatus including a ramp for engaging a positionally fixed element such that when said mechanism horizontally moves said transport apparatus to increase said gap, said ramp slides along said positionally fixed element, causing said first end to rise; and a locking device for locking said transport apparatus at adjustable distances from said pair of front cutting blades.

2. The apparatus according to claim 1, wherein said transport apparatus has a second end opposite said first end and facing away from said trimmer, said second end being configured to move longitudinally together with said first end.

* * * * *